US010010895B2

(12) United States Patent
Anderson

(10) Patent No.: US 10,010,895 B2
(45) Date of Patent: Jul. 3, 2018

(54) SYSTEM AND METHOD FOR THE THERMAL MONITORING AND PROTECTION OF AN ELECTRICALLY POWERED AIRLESS PAINT SPRAYER

(71) Applicant: TRITECH INDUSTRIES, INC., Union, NJ (US)

(72) Inventor: Troy Anderson, Blacksburg, VA (US)

(73) Assignee: TriTech Industries Inc., Union, NJ (US)

( * ) Notice: Subject to any disclaimer, the term of this patent is extended or adjusted under 35 U.S.C. 154(b) by 142 days.

(21) Appl. No.: 15/271,417

(22) Filed: Sep. 21, 2016

(65) Prior Publication Data

US 2018/0078960 A1 Mar. 22, 2018

(51) Int. Cl.

| | |
|---|---|
| ***B05B 5/08*** | (2006.01) |
| ***B05B 12/00*** | (2018.01) |
| ***B05B 11/00*** | (2006.01) |
| ***B05B 12/08*** | (2006.01) |

(52) U.S. Cl.
CPC ..... *B05B 11/3001* (2013.01); *B05B 12/087* (2013.01)

(58) Field of Classification Search
CPC .... B05B 5/00; B05B 5/03; B05B 5/08; B05B 7/12; B05B 12/00
USPC ..... 318/481, 482; 239/290, 600
See application file for complete search history.

(56) References Cited

U.S. PATENT DOCUMENTS

| | | | | |
|---|---|---|---|---|
| 3,593,308 | A * | 7/1971 | Fagan | B05B 13/0447 118/679 |
| 3,637,135 | A * | 1/1972 | Luderer | B05B 5/032 118/621 |
| 5,188,290 | A * | 2/1993 | Gebauer | B05B 5/03 239/132 |
| 6,977,013 | B2 * | 12/2005 | Schroeder | B05B 5/00 118/679 |
| 2008/0251607 | A1 * | 10/2008 | Krayer | B05B 7/0081 239/290 |

* cited by examiner

*Primary Examiner* — Bentsu Ro
(74) *Attorney, Agent, or Firm* — Bucknam and Archer

(57) ABSTRACT

An integrated system and method are provided in an electrically powered airless paint spray unit for thermally monitoring the heat generating elements of the spray unit and provide thermal protection for the spray unit and the monitored heat generating elements. The temperatures of various heat generating elements of the paint spray unit are measured and directed to the motor controller of the electric motor of the unit the microprocessor of which is programmed to adjust the power level to the motor in response to excessive temperature readings of the monitored elements or shut off power to the motor in the event any of the temperature readings are greater than a maximum temperature assigned to the monitored element.

16 Claims, 6 Drawing Sheets

Continued on

SYSTEM AND METHOD FOR THE THERMAL MONITORING AND PROTECTION OF AN ELECTRICALLY POWERED AIRLESS PAINT SPRAYER

FIELD OF THE INVENTION

The present invention relates generally to an electrically powered airless paint sprayer wherein the pump of the paint sprayer is adapted to pump liquid paint to a sufficiently high pressure that upon release of the pressurized paint from the nozzle of a spray gun communicating with the pump the paint is atomized and thereby rendered suitable for spray painting. More particularly, the present invention relates to such an electrically powered airless paint sprayer which includes an integrated thermal monitoring and protection system and method adapted to protect those elements of the paint sprayer subject to thermal overload or heat related damage.

BACKGROUND OF THE INVENTION

In hydraulic or airless paint spraying a pump is utilized to pressurize the paint to a sufficiently high pressure so that the paint is atomized upon release from the nozzle of a spray gun attached to the pump outlet by a high pressure hose. The type of pump preferably used for this purpose is the double acting piston pump because of the piston pump's ability to handle high viscosity paints or coatings easily and the capability of the double acting piston pump to pump fluid on both the upstroke and downstroke of the piston thereby providing a continuous flow of paint to the spray gun. An example of such a pump is described in U.S. Patent Publication No. 20160069344, the disclosure of which is incorporated herein by reference.

Such high pressure paint spray pumps are generally driven by a permanent, magnet direct current (PMDC) brushed, brushless or universal electric motor operating on normal residential or commercial 120 or 240 volt alternating current service. The electric motor and the pump are combined together in a unit wherein the motor drive shaft drives the pump through a reduction gear and crank shaft housed in a gear box of the unit. The unit also includes a control box which houses a power supply for the motor and a microprocessor for controlling operation of the motor. Such an electrically operated paint spray unit includes a number of hear generating elements which, if the heat generated thereby becomes excessive, could result in damage or failure of one or more of the electrical components of the paint spray unit with the consequent interruption or cessation of pump operation.

SUMMARY OF THE INVENTION

It is a primary object of the present invention to incorporate in an electrically powered airless paint spray unit a system and method for thermally monitoring the heat generating elements of the spray unit and provide for the thermal protection of the unit and the heat generating elements thereof.

The above object, as well as others which will hereinafter become apparent, is accomplished in accordance with the present invention by providing an electrically powered airless paint spray unit with a plurality of temperature sensors suitable for measuring the temperatures of heat generating electrical elements or components of the spray unit during operation of the unit and a system and method for preventing heat related damage to the electrical elements or components of the unit based on the temperature readings of the temperature sensors. Temperature sensors are arranged in the spray unit to measure the temperatures of the electric motor driving the paint pump as well as the electrical elements or components supplying power to and controlling the operation of the electric motor. These measured temperatures are then communicated to the microprocessor or microcontroller controlling motor operation. The microcontroller is programmed to monitor the various temperatures and shut down motor operation in the event any of the measured temperatures exceeds a maximum assigned to the element or component the temperature of which is being monitored. The microcontroller is also programed to reduce power to the motor in the event any one or more of the measured temperatures of the various elements or components being monitored is below its assigned maximum but within a predetermined power reduction region. If each of the measured temperatures of the various monitored elements or components of the paint sprayer unit is below the assigned power reduction region therefor, then the microcontroller is programmed to permit the motor to be powered normally.

BRIEF DESCRIPTION OF THE DRAWINGS

Other objects and features of the present invention will become apparent from the following detailed description considered in connection with the accompanying drawings. It is to be understood that the drawings are designed as an illustration only and not as a definition of the limits of the present invention.

In the drawings wherein similar reference characters denote similar elements throughout the several views.

DETAILED DESCRIPTION OF THE INVENTION

Figure 1:
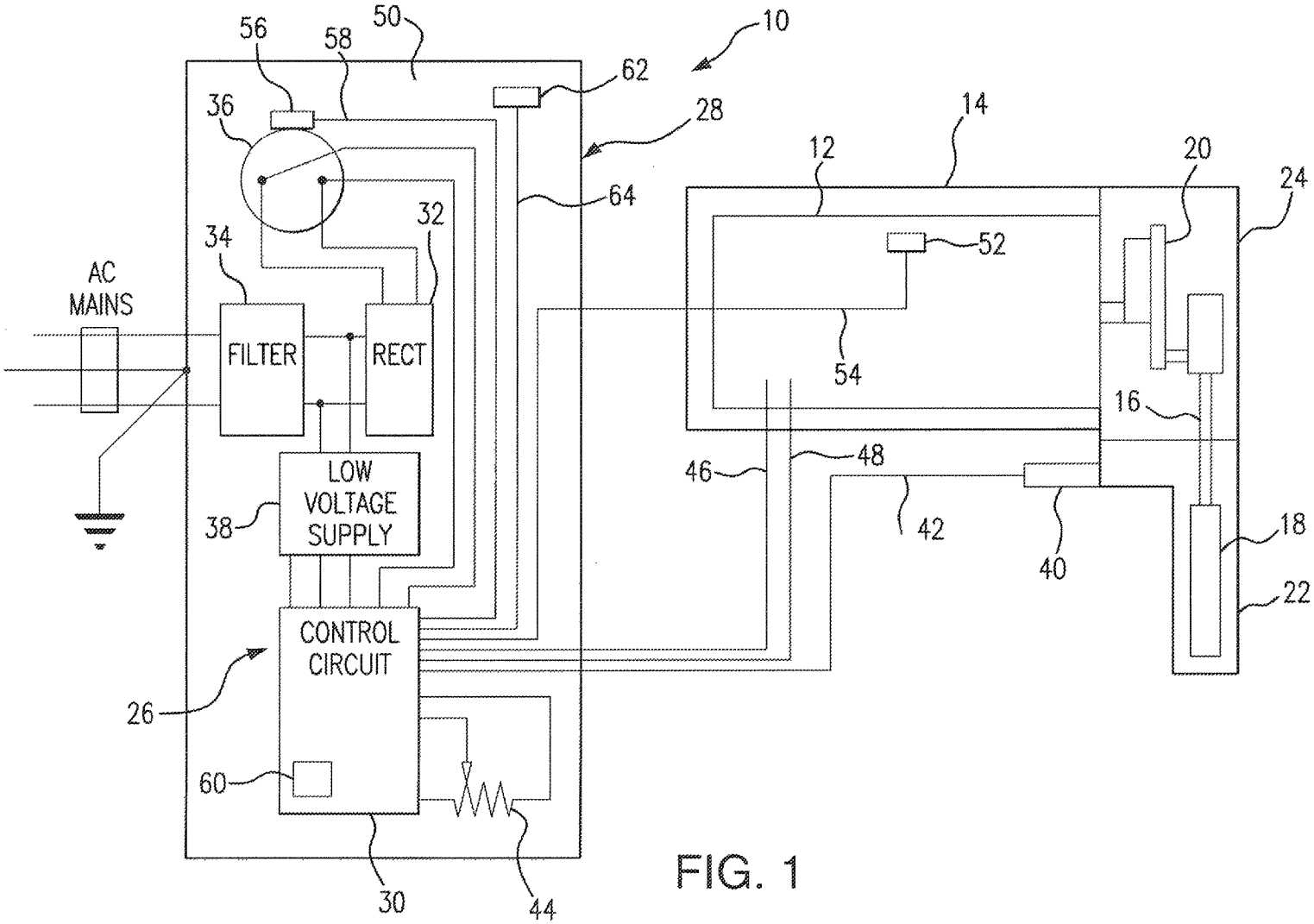
FIG. 1 is a block diagram schematically illustrating an airless paint spray unit and control elements controlling and supplying power to the electric motor thereof according to the present invention wherein the power supply is a rectified/filtered power supply.

Now turning to the drawings, there is shown in FIG. 1 a block diagram schematically illustrating an airless paint spray unit according to one embodiment of the present invention, generally designated 10, including the control elements controlling and supplying power to the electric motor thereof. The electric motor 12 of spray unit 10 is housed in motor section 14 and drives the crank shaft 16 of piston pump 18 through the motor drive shaft and reduction gear 20. Piston pump 18 is housed in pump section 22 of unit 10 and the motor drive shaft and reduction gear 20 are housed in gear box 24 of unit 10. The motor control elements, generally designated 26, are housed in a control box 28 of paint spray unit 10 and include a control circuit 30, a power supply 32, an EMI filter 34, a filter capacitor 36, and a low voltage supply 38. Control circuit 30 includes a microprocessor, at motor transistor, and a motor flyback diode. Power supply 32 of the embodiment of FIG. 1 is a full wave bridge rectifier connected at its input terminals to the AC mains through EMI filter 34 and converts the inputted AC power to direct current (DC) power so as to power PMDC motor 12.

The microprocessor of control circuit 30 may be any suitable data processing device capable of being programmed to accept input signals, compare the input signals with predetermined threshold levels and/or manipulate the input signals or comparison data as required, and output various control signals in response to the input signals and/or signal manipulations or comparisons. An example of a suitable microprocessor is PIC 16F1828 manufactured by Microchip Technology Inc. of Chandler, Ariz. Control circuit 30 is powered by the AC mains through EMI filter 34 and low voltage supply 38 and is connected to a pressure sensor 40 via line 42 which senses the output pressure of pump section 22 of paint spray unit 10. An adjustable potentiometer 44 is operatively connected to control circuit 30 and sets the operating pressure of pump 18 by means of a control knob (not shown). In the normal operation of pump 18, the microprocessor reads the pump output pressure from sensor 40 and the operating pressure set by potentiometer 44, compares the two and regulates the power supplied to motor 12 via lines 46 and 48 as required to maintain the pump output pressure at the set operating pressure. As further described below, the microprocessor is also set to read the temperatures of various critical electrical elements or components of spray unit 10 transmitted to it from temperature sensors connected to the various elements. The microprocessor monitors the received temperatures so as to prevent thermal overload or heat related damage to the electrical elements or components of the spray unit or to the unit itself by reducing or regulating power to motor 12 or shutting off power to the motor completely.

The critical elements of the spray unit whose temperatures are monitored include electric motor 12, filter capacitor 36, the microprocessor of control circuit 30, and control box heat sink floor 50. Motor 12 has a temperature sensor 52 arranged internally of the motor and which is electrically connected to the microprocessor of control circuit 30 via line 54. Filter capacitor 36 has a temperature sensor 56 associated with it which is electrically connected to. the microprocessor of control circuit 30 via line 58. The microprocessor has an internally arranged temperature sensor 60. Heat sink 50 is provided with a temperature sensor 62 electrically connected to the microprocessor of control circuit 30 via line 64. The purpose of monitoring the temperature of heat sink 50 is to thermally protect a plurality of heat producing electrical elements which are mounted on the heat sink for heat dissipation. These heat producing electrical elements comprise the power components of the power supply and motor control and include the motor transistor and the motor flyback diode contained in control circuit 30, and rectifier 32.

Figures 2A, 2B:
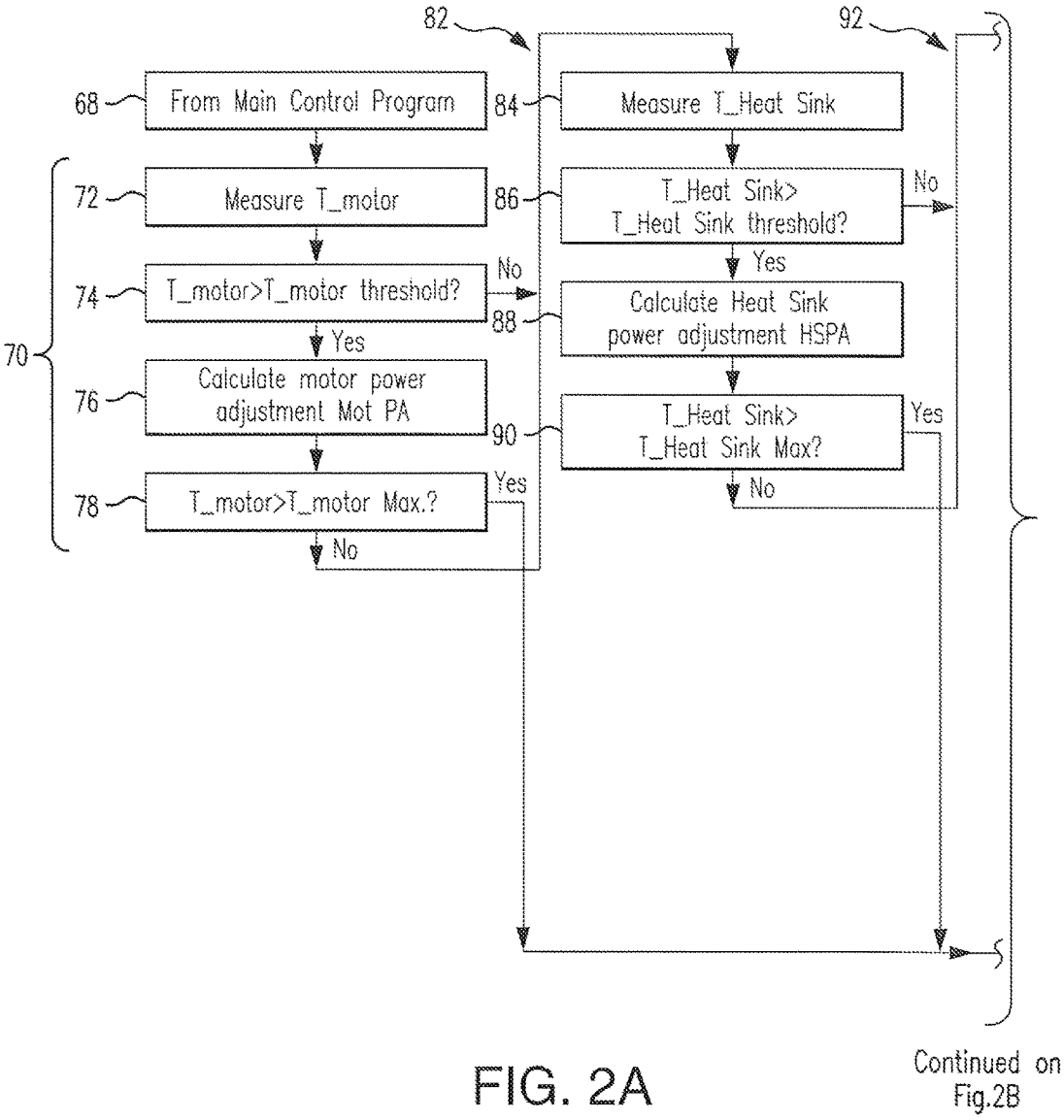
FIG. 2A-2B is a flow chart of the thermal management control process portion of the power management control program for the airless paint spray unit shown in FIG. 1.

FIG. 2A-2B shows a flow chart of the thermal management control process, designated 66, of the power management control program executed by the microprocessor of control circuit 30 of the airless paint spray unit 10 of FIG. 1. Thermal management control process 66 is delinated into several series of process steps each related to the thermal code of the component being monitored. As clearly seen, the microprocessor continues at step 68 from the main control program to the first series 70 related to the thermal code process steps 72, 74, 76, and 78 for the temperature monitoring of motor 12. Thus, step 72 measures the motor temperature $T_{motor}$ of motor 12 received from temperature sensor 52. At step 74, $T_{motor}$ is compared with a motor threshold temperature $T_{motor\ threshold}$ and, if it is greater, at step 76 a motor power adjustment Mot PA is calculated and at step 78 if $T_{motor}$ is greater than the maximum temperature allowed for motor 12, $T_{motor\ max}$, the motor is shutdown at step 80. If at step 74, the motor temperature $T_{motor}$ is less than the motor threshold temperature $T_{motor\ threshold}$ the program proceeds to heat sink thermal code process steps series 82 and to step 84 where the temperature of heat sink 50 $T_{heat\ sink}$ received from temperature sensor 62 is measured. Also, if at step 78, the motor temperature $T_{motor}$ does not exceed $T_{motor\ max}$ the program continues to step 84. At step 86 the temperature of the heat sink $T_{heat\ sink}$ is compared to a heat sink threshold temperature $T_{heat\ sink\ threshold}$ and, if it is greater, at step 88 a heat sink power adjustment HSPA is calculated and at step 90 if the temperature of the heat sink $T_{heat\ sink}$ is greater than the maximum temperature allowed for heat sink 50 $T_{heat\ sink\ max}$, the motor is shut down at step 80. If at step 86 the heat sink temperature $T_{heat\ sink}$ is less than the heat sink threshold temperature $T_{heat\ sink\ threshold}$, the program proceeds to filter capacitor thermal code process steps series 92 and to step 94 where the temperature of filter capacitor 36 $T_{capacitor}$ from temperature sensor 56 is measured. Also, if at step 90, the heat sink temperature $T_{heat\ sink}$ does not exceed $T_{heat\ sink\ max}$ the program continues to step 94. At step 96 the temperature of filter capacitor 36 $T_{capacitor}$ is compared to a filter capacitor threshold temperature $T_{capacitor\ threshold}$ and, if it is greater, at step 98 a filter capacitor power adjustment CPA is calculated and at step 100 if the temperature of the filter capacitor $T_{capacitor}$ is greater than, the maximum temperature allowed for filter capacitor 36 $T_{capacitor\ max}$, the motor is shut down at step 80. If at step 96 the filter capacitor temperature $T_{capacitor}$ is less than the filter capacitor threshold temperature $T_{capacitor\ threshold}$ the program proceeds to microprocessor thermal code process steps series 102 and to step 104 where the temperature of the microprocessor $T_{microprocessor}$ from its own temperature sensor 60 is measured. Also, if at step 100, the filter capacitor temperature $T_{capacitor}$ does not exceed $T_{capacitor\ max}$, the program, continues to step 104. At step 106 the temperature of the microprocessor $T_{microprocessor}$ is compared to a microprocessor threshold temperature $T_{microprocessor\ threshold}$ and, if it is greater, at step 108 a microprocessor power adjustment MicPA is calculated and at step 110 if the temperature of the microprocessor $T_{microprocessor}$ is greater than the maximum temperature allowed for the microprocessor $T_{microprocessor\ max}$, the motor 12 is shut down at step 80. If at step 106 the microprocessor temperature $T_{microprocessor}$ is less than the microprocessor threshold temperature $T_{microprocessor\ threshold}$ or the program proceeds directly to step 112. Also, if at step 110 the microprocessor temperature $T_{microprocessor}$ is not greater than $T_{microprocessor\ max}$, then in the next step 112 the power adjustments of steps 76, 88, 98 and 108 are added to determine the total power adjustment based on which the motor power level is set in step 114. The program then returns to the main control program at step 116. Based on the set motor power level of step 114, the microprocessor is programmed to adjust the pulse width modulation (PWM) duty cycle so as to control the power supplied to motor 12.

As can be understood from the above description of the thermal management control process 66 of FIG. 2A-2B, in the case of each monitored component, the power delivered to motor 12 is adjusted downwardly so as to avoid or prevent thermal breakdown of the component or of the unit in the temperature range between the component threshold temperature and the component maximum allowable temperature. In this power reduction region, as the measured temperature of the component increases, the greater is the power reduction for motor 12. The maximum temperatures allowed as indicated in FIG. 2A-2B for each of the monitored components are determined and recommended by the manufacturers of the individual components. With respect to heat sink 50, the maximum temperature allowed is derived on the basis of the lowest recommended maximum component temperature among the heat producing components or elements mounted on heat sink 50. Among the components mounted on the heat sink the one with the lowest recommended maximum temperature is the motor transistor which thus is used to determine the maximum temperature allowed for heat sink 50. With respect to the threshold temperatures for the various components, which determine the initiation of the power foldback or power reduction region in connection with each component, these are arrived at empirically. Each component is tested and retested and the initiation of the power reduction region adjusted and readjusted until the power foldback operates satisfactorily by maintaining pump operation, albeit at a lower operating pressure, while avoiding unacceptable temperature increases in the tested component.

Figure 3:
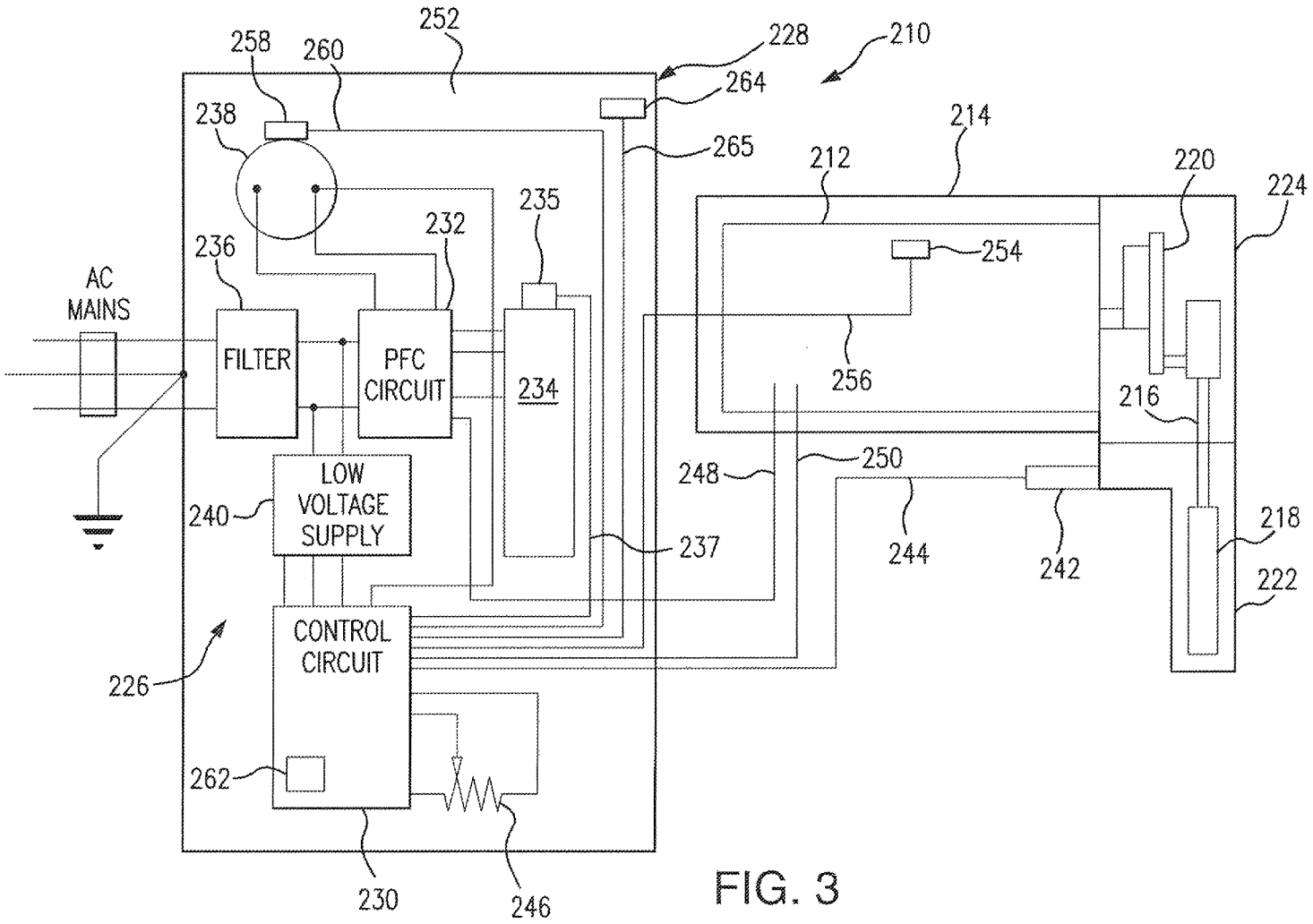
FIG. 3 is a block diagram schematically illustrating an airless paint spray unit and control elements controlling and supplying power to the electric motor thereof according to the present invention wherein the power supply is an active Power Factor Correction (PFC) switching power supply.

Turning now to FIG. 3, therein is shown a block diagram, schematically illustrating an airless paint spray unit according to a second embodiment of the present invention, generally designated 210. The airless paint spray unit 210 of FIG. 3 is substantially similar to the spray unit 10 of FIG. 1 except that the power supply is an active Power Factor Correction (PFC) switching power supply supplying electric power to the motor 212 of spray unit 210. Such an application of a PFC power supply in an airless paint spray unit is the subject of U.S. patent application Ser. No. 15/097,338, the subject matter of which is herein incorporated by reference. Electric motor 212 of spray unit 210 is housed in motor section 214 and drives the crank shaft 216 of piston pump 218 through the motor drive shaft and reduction gear 220. Piston pump 218 is housed in pump section 222 of unit 210 and the motor drive shaft and reduction gear 220 are housed in gear box 224 of unit 210. The motor control elements, generally designated 226, are housed in a control box 228 of paint spray unit 210 and include a control circuit 230, a PFC power supply circuit 232, a PFC inductor 234, an EMI filter 236, a filter capacitor 238, and a low voltage supply 240. Control circuit 230 includes a microprocessor, a motor transistor, and a motor flyback diode. PFC power supply circuit 232 is connected at its input terminals to the AC mains through EMI filter 236 and together with PFC inductor 234 converts the inputted AC power to DC power so as to power PMDC motor 212. PFC power supply circuit 232 also includes a full wave bridge rectifier, a PFC transistor, and a PFC flyback diode.

The microprocessor of control circuit 230 is the same as or very similar to the microprocessor of control circuit 30 described in connection with spray unit 10 of FIG. 1. The microprocessor of control circuit 230 is powered by the AC mains through EMI filter 236 and low voltage supply 240 and is connected to a pressure sensor 242 via line 244 which senses the output pressure of pump section 222 of paint spray unit 210. An adjustable potentiometer 246 is connected to control circuit 230 and sets the operating pressure of pump 218 by means of a control knob (not shown). In the normal operation of pump 218, the microprocessor reads the pump output pressure from sensor 242 and the operating pressure set by potentiometer 246, compares the two and regulates the power supplied to motor 212 via line 248 connected to PFC power supply circuit 232 and line 250 connected to control circuit 230. The power supplied to motor 212 is regulated during normal operation by control circuit 230 so as to maintain the pump output pressure at the set operating pressure. As described in connection with sprayer unit 10 of FIG. 1, the microprocessor is also set to read the temperatures of various critical electrical elements or components of spray unit 210 transmitted to it from temperature sensors connected to the various elements. As is described above with respect to spray unit 10, the microprocessor monitors the received temperatures so as to prevent thermal overload or heat related damage to the electrical elements or components of spray unit 210 or to the unit itself by reducing or regulating power to motor 212 or shutting off power to the motor completely.

The critical elements of spray unit 210 whose temperatures are monitored include electric motor 212, filter capacitor 238, microprocessor 230, PFC inductor 234, and control box heat sink floor 252. Motor 212 has a temperature sensor 254 arranged internally of the motor and which is electrically connected to the microprocessor of control circuit 230 via line 256. Filter capacitor 238 has a temperature sensor 258 connected to the microprocessor of control circuit 230 via line 260. The microprocessor has an internally arranged temperature sensor 262. PFC inductor 234 has a temperature sensor 235 electrically connected to the microprocessor of gfcontrol circuit 230 via line 237. Heat sink 252 is provided with a temperature sensor 264 electrically connected to the microprocessor control circuit 230 via line 265. As in the case of the sprayer unit embodiment of FIG. 1, the purpose of monitoring the temperature of heat sink 252 is to thermally protect a plurality of heat producing electrical elements which are mounted on the heat sink for heat dissipation. These heat producing electrical elements comprise the power components of the power supply and motor control and include the motor transistor and motor flyback diode of control circuit 230, and the rectifier, PFC transistor, and PFC flyback diode of the PFC power supply circuit 232.

Figure 2B:
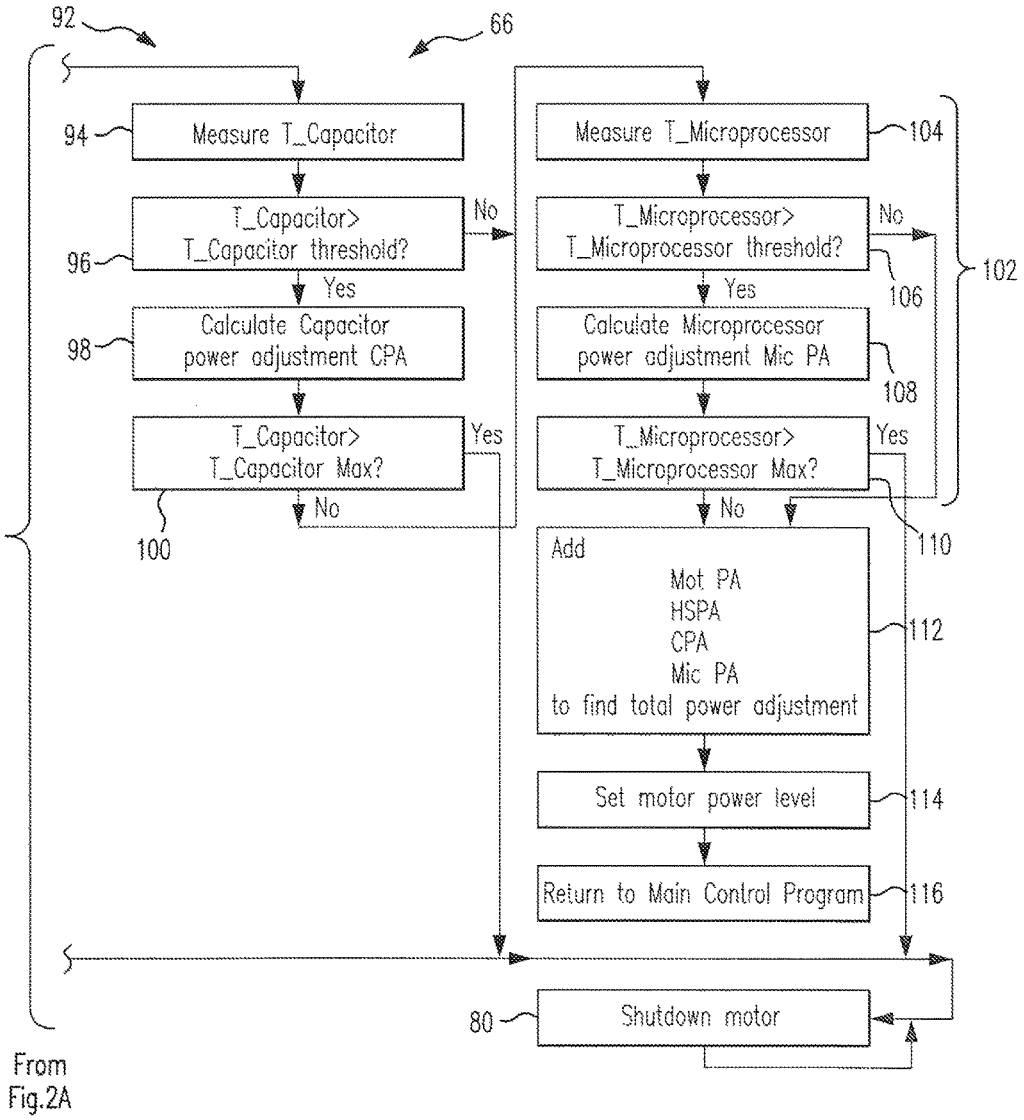
Figure 4A:
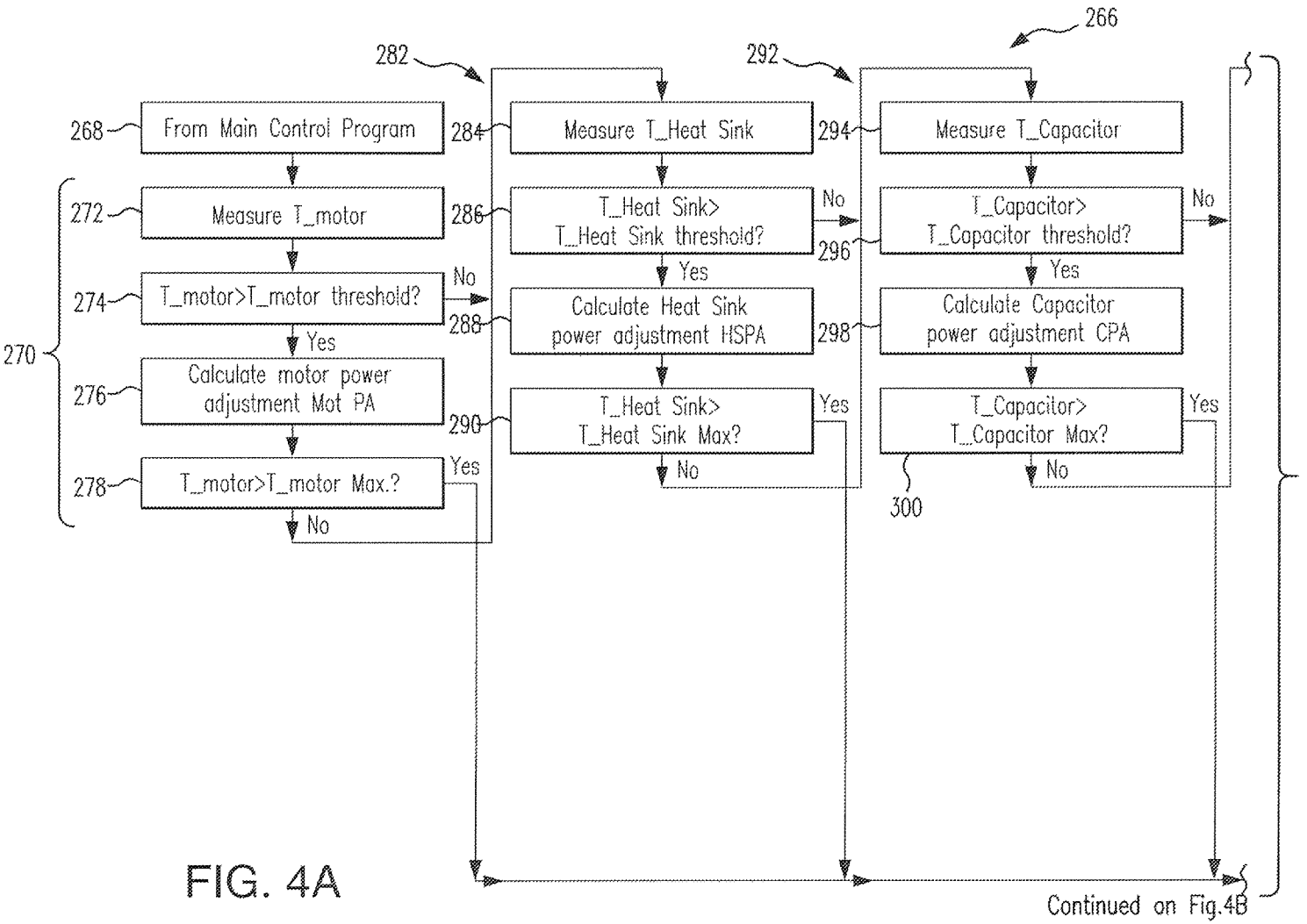
FIG. 4A-4B is a flow chart of the thermal management control process portion of the power management control program for the airless paint spray unit shown in FIG. 3.
Figure 4B:
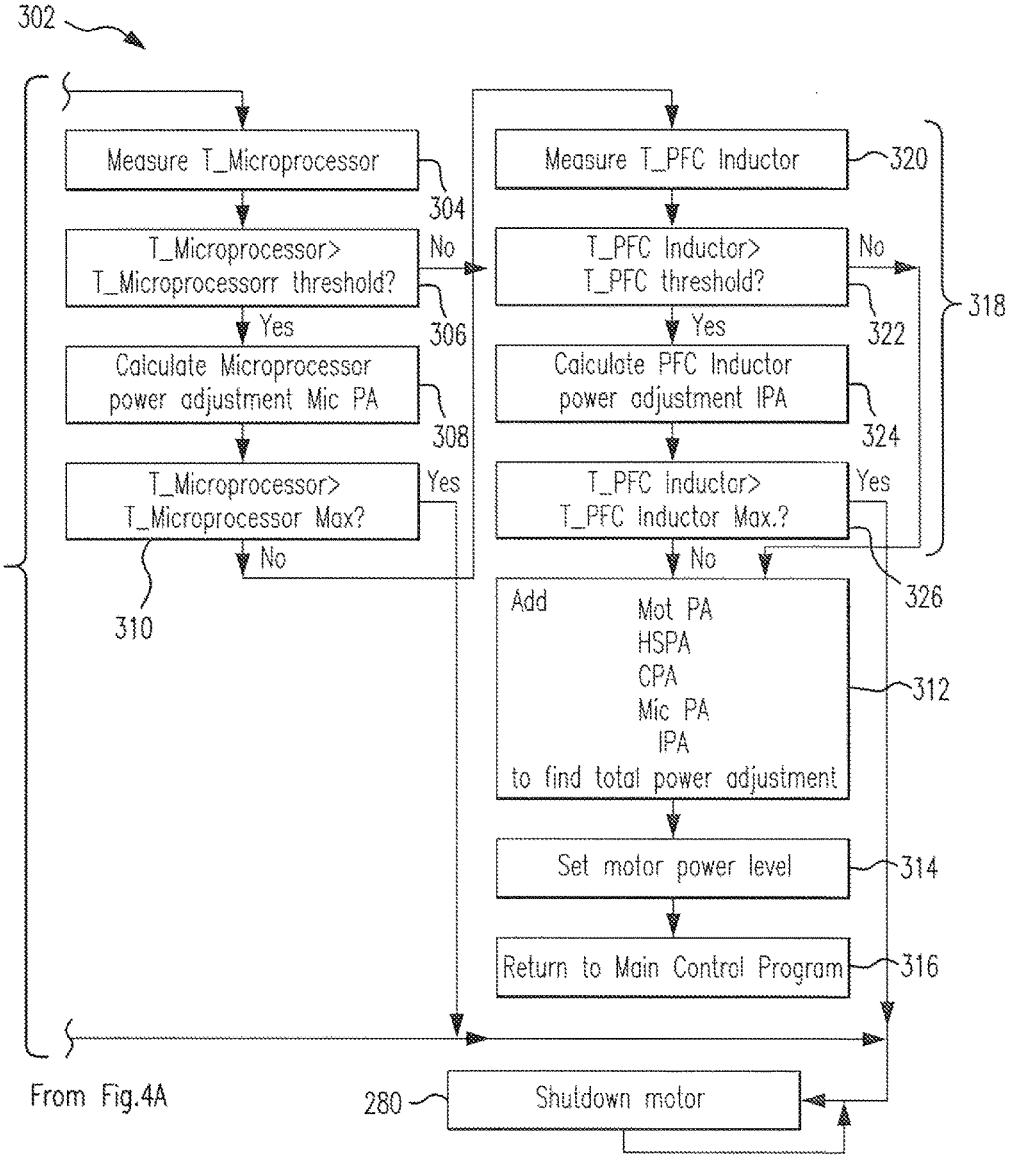

FIG. 4A-4B shows a flow chart of the thermal management control process portion, designated 266, of the power management control program executed by the microprocessor of control circuit 230 of the airless paint spray unit 210 of FIG. 3. The embodiment of the paint spray unit of FIG. 3 is in many respects identical to the embodiment of FIG. 1. The major difference between the two embodiments has to do with the power supply supplying power to the PMDC motors of the two units. The only additional heat generating component added by the. embodiment of FIG. 3 and which is provided with a temperature sensor is the PFC inductor 234 which is associated with PFC power supply circuit 232. As a result, the only difference between the thermal management control of 266 of FIG. 4A-4B and the thermal management control 66 of FIG. 2A-2B is the addition of a series of thermal code process steps, designated 318, specifically directed to the temperature monitoring of PFC inductor 234. Thus, motor thermal code process steps series 270 is identical in operation to the comparable series 70 of FIG. 2; heat sink thermal code process steps series 282 is identical in operation to the comparable series 82 of FIG. 2A-2B; filter capacitor thermal code process steps series 292 is identical in operation to the comparable series 92 of FIG. 2A-2B; and microprocessor thermal code process steps series 302 is identical, in operation to the comparable series 102. Also, process steps 268, 280, 312, 314, and 316 of FIG.

4A-4B are identical in operation to the comparable process steps 68, 80, 112, 114, and 116 identified and described in connection with FIG. 2A-2B.

PFC inductor thermal code process steps series 313 can be inserted into the thermal management control process 266 of FIG. 4A-4B at any step before or after process steps series 270, 282, 222, or 302. For the sake of convenience herein, process steps series 318 is added to the thermal management control process 266 following process steps series 302. Thus, if at step 310 the temperature $T_{microprocessor}$ is greater than the maximum temperature allowed for microprocessor 230 $T_{microprocessor\ max}$, motor 212 is shut down at step 280. If at step 306 the temperature $T_{microprocessor}$ is less than the microprocessor threshold temperature $T_{microprocessor\ threshold}$ the program proceeds to PFC inductor thermal code process steps series 318 and to step 320 where the temperature of PFC inductor 234 $T_{PFC\ inductor}$ from temperature sensor 235 is measured. Also, if at step 310 the microprocessor temperature $T_{microprocessor}$ does not exceed $T_{microprocessor\ max}$, the program continues to step 320. At step 322 the temperature of PFC inductor 234 $T_{PFC\ inductor}$ is compared to a PFC inductor threshold temperature $T_{PFC\ threshold}$ and, if it is greater, at step 324 a PFC inductor power adjustment IPA is calculated and at step 326 if the temperature of the PFC inductor $T_{PFC\ inductor}$ is greater than the maximum temperature allowed for PFC inductor 234 $T_{PFC\ inductor\ max}$, motor 212 is shut down at step 280. If at step 322 the PFC inductor temperature $T_{PFC\ inductor}$ is less than the PFC inductor threshold temperature $_{PFC\ inductor\ threshold}$ the program proceeds directly to step 312. Also, if at step 326 the PFC inductor temperature $T_{PFC\ inductor}$ is not greater than $T_{PFC\ inductor\ max}$, then in the next step 312 the power adjustments of steps 276, 288, 298, 308, and 324 are added to determine the total power adjustment based on which the motor power level is set in step 314. The program then returns to the main control program at step 316. As in the case of the embodiment of FIG. 1, based on the set motor power level of step 314, the microprocessor is programmed to adjust the pulse width modulation (PWM) duty cycle so as to control the power supplied to motor 212.

Any suitable temperature sensor may be used in connection with the various components described above, other than in connection with the microprocessor motor controller which is provided with its own temperature sensor by the manufacturer thereof. For various reasons, a preferred type of temperature sensor is a negative temperature coefficient (NTC) thermistor. A suitable thermistor for this application is the NTCLG100E2103JB produced by Vishay Intertechnology, Inc. of Malverne, Pa.

As stated herein above, apart from the description of the process steps given in the preceding paragraph, all other process steps of FIG. 4A-4B are identical in substance and operation to the process steps of FIG. 2A-2B.

While two embodiments of the present invention have been shown and described, it is to toe understood that many changes and modifications may be made thereto without departing from the spirit and scope of the invention.

What is claimed:

1. In an electrically powered airless paint spray unit powered by alternating current (AC) mains comprising a pump adapted to pump liquid paint to a pressure sufficient to allow the paint to be hydraulically atomized suitable for spray painting upon release from a spray tip of a spray gun communicating with an outlet of said pump, said pump including a pressure sensor for sensing the outlet pressure of said pump; a direct current (DC) motor adapted to drive said pump; a motor control system providing a power supply and control of the operation of said motor including a full wave bridge rectifier for converting the inputted AC power to DC power so as to power said DC motor, an EMI filter, a filter capacitor, a low voltage supply, and a control circuit for controlling motor operation, wherein the control circuit includes a microprocessor, a motor transistor, a motor flyback diode, and an adjustable potentiometer for setting an outlet pressure of said pump, said microprocessor being adapted to compare the pump outlet pressure with the pressure set on said potentiometer and regulate the power to the pump so as to adjust the sensed outlet pressure to correspond with the pressure set on said potentiometer; and a heat sink for dissipating the heat produced by elements connected thereto including said rectifier, said motor transistor, and said motor flyback diode, the improvement comprising:

an integrated system for thermally monitoring and protecting the electrically powered airless paint spray unit, wherein a separate temperature sensor is associated with each of said motor, said filter capacitor, said microprocessor, and said heat sink for measuring the temperatures thereof during operation of said airless paint spray unit, said temperature sensors communicating with said microprocessor so as to transmit the measured temperatures to said microprocessor, wherein said microprocessor is adapted to compare the measured temperatures of said motor, said filter capacitor, said microprocessor, and said heat sink transmitted to said microprocessor with a predetermined set threshold temperature assigned to each component whose temperature is measured and based on said comparisons, regulating power supplied to said motor.

2. The electrically powered airless paint spray unit as defined in claim 1, wherein the predetermined set threshold temperature assigned to each component whose temperature is measured is a foldback threshold temperature assigned to that component and, if the measured temperature of that component exceeds the foldback threshold temperature assigned to that component, the microprocessor is adapted to reduce the power supplied to said motor in an amount associated with that component.

3. The electrically powered airless paint spray unit as defined in claim 2, wherein the power reduction to said motor resulting from a measured temperature of a component whose temperature is measured exceeds the foldback threshold temperature assigned to that component is such as to reduce the measured temperature of that component to less than the foldback threshold temperature assigned to that component.

4. The electrically powered airless paint spray unit as defined in claim 2, wherein if the measured temperature of more than one component whose temperature is measured exceeds the foldback threshold temperature for that component, the power reduction amounts associated with the components whose measured temperatures exceed the assigned foldback threshold temperatures for those components are additive to determine a total power reduction to said motor.

5. The electrically powered airless paint spray unit as defined in claim 2, wherein the foldback threshold temperature assigned to each component whose temperature is measured is determined empirically.

6. The electrically powered airless paint spray unit as defined in claim 1, wherein the predetermined set threshold temperature assigned to each component whose temperature is measured is a maximum threshold temperature assigned to that component and if the measured temperature of that component exceeds the maximum threshold temperature assigned to that component, the microprocessor is adapted to shut down power supplied to said motor.

7. The electrically powered airless paint spray unit as defined in claim 6, wherein the maximum threshold temperature assigned to said heat sink is based on the lowest maximum threshold temperature assigned among the elements connected to said heat sink for dissipating the heat produced by said elements.

8. The electrically powered airless paint spray unit as defined in claim 1, wherein the predetermined set threshold temperature assigned to each component whose temperature is measured includes a maximum, threshold temperature assigned to each such component and a foldback threshold temperature assigned to each such component lower than the maximum threshold temperature assigned to such component, and wherein the microprocessor is adapted to shut down power supplied to said motor if the measured temperature of a component whose temperature is measured exceeds the maximum threshold temperature assigned to such component and, if the measured temperature of a component whose temperature is measured exceeds the foldback threshold temperature assigned to that component, the microprocessor is adapted to reduce the power supplied to said motor in an mount associated with that component.

9. In an electrically powered airless paint spray unit powered by alternating current (AC) mains comprising a pump adapted to pump liquid paint to a pressure sufficient to allow the paint to be hydraulically atomized suitable for spray painting upon release from a spray tip of a spray gun communicating with an outlet of said pump, said pump including a pressure sensor for sensing the outlet pressure of said pump; a direct current (DC) motor adapted to drive said pump; a motor control system providing a power supply and control of the operation of said motor including an EMI filter, a filter capacitor, and a low voltage supply, wherein the power supply is an active PFC power supply circuit including a full wave bridge rectifier, a PFC transistor , a PFC flyback diode, and a PFC conductor, and a control circuit for controlling motor operation, wherein the control circuit includes a microprocessor, a motor transistor, a motor flyback diode, and an adjustable potentiometer for setting an outlet pressure of said pump, said microprocessor being adapted to compare the pump outlet pressure with the pressure set on said potentiometer and regulate the power to the pump so as to adjust the sensed outlet pressure to correspond with the pressure set on said potentiometer; and a heat sink for dissipating the heat produced by elements connected thereto including said rectifier, said motor transistor, said motor flyback diode, said PFC transistor, and said PFC flyback diode, the improvement comprising:

an integrated system for thermally monitoring and protecting the electrically powered airless paint spray unit, wherein a separate temperature sensor is associated with each of said motor, said filter capacitor, said microprocessor, said PFC inductor, and said heat sink for measuring the temperatures thereof during operation of said airless paint spray unit, said temperature sensors communicating with said microprocessor so as to transmit the measured temperatures to said microprocessor, wherein said microprocessor is adapted to compare the measured temperatures of said motor, said filter capacitor, said microprocessor, said PFC inductor, and said heat sink transmitted to said microprocessor with a predetermined set threshold temperature assigned to each component whose temperature is measured and based on said comparisons, regulating power supplied to said motor.

10. The electrically powered airless paint spray unit as defined in claim 9, wherein the predetermined set threshold temperature assigned to each component whose temperature is measured is a foldback threshold temperature assigned to that component and, if the measured temperature of that component exceeds the foldback threshold temperature assigned to that component, the microprocessor is adapted to reduce the power supplied to said motor in an amount associated with that component.

11. The electrically powered airless paint spray unit as defined in claim 10, wherein the power reduction to said motor resulting from a measured temperature of a component whose temperature is measured exceeds the foldback threshold temperature assigned to that component is such as to reduce the measured temperature of that component to less than the foldback threshold temperature assigned to that component.

12. The electrically powered airless paint spray unit as defined in claim 10, wherein if the measured temperature of more than one component whose temperature is measured exceeds the foldback threshold temperature for that component, the power reduction amounts associated with the components whose measured temperatures exceed the assigned foldback threshold temperatures for those components are additive to determine a total power reduction to said motor.

13. The electrically powered airless paint spray unit as defined in claim 10, wherein the holdback threshold temperature assigned to each component whose temperature is measured is determined empirically.

14. The electrically powered airless paint spray unit as defined in claim 9, wherein the predetermined set threshold temperature assigned to each component whose temperature is measured is a maximum threshold temperature assigned to that component and if the measured temperature of that component exceeds the maximum threshold temperature assigned to that component, the microprocessor is adapted to shut down power supplied to said motor.

15. The electrically powered airless paint spray unit as defined in claim 14, wherein the maximum threshold temperature assigned to said heat sink is based on the lowest maximum threshold temperature assigned among the elements connected to said heat sink for dissipating the heat produced by said elements.

16. The electrically powered airless paint spray unit as defined in claim 9, wherein the predetermined set threshold temperature assigned to each component whose temperature is measured includes a maximum threshold temperature assigned to each such component and a foldback threshold temperature assigned to each such component lower than the maximum threshold temperature assigned to such component, and wherein the microprocessor is adapted to shut down power supplied to said motor if the measured temperature of a component whose temperature is measured exceeds the maximum threshold temperature assigned to such component and, if the measured temperature of a component whose temperature is measured exceeds the foldback threshold temperature assigned to that component, the microprocessor is adapted to reduce the power supplied to said motor in an mount associated with that component.

* * * * *